US008769737B1

(12) United States Patent
Duggins

(10) Patent No.: US 8,769,737 B1
(45) Date of Patent: Jul. 8, 2014

(54) NEST-LIKE INFANT BED SYSTEM

(76) Inventor: Michael D. Duggins, Basseterre (KN)

( * ) Notice: Subject to any disclaimer, the term of this patent is extended or adjusted under 35 U.S.C. 154(b) by 245 days.

(21) Appl. No.: 13/472,481

(22) Filed: May 16, 2012

(51) Int. Cl.
*A47D 9/00* (2006.01)
*A47D 7/00* (2006.01)

(52) U.S. Cl.
USPC ..... 5/93.1; 5/101; 5/108; 5/284; 5/421; 5/731; 5/904; 5/915

(58) Field of Classification Search
USPC ..... 5/93.1, 101, 105, 108, 109, 284, 400, 5/411, 421, 731, 733, 904, 915
See application file for complete search history.

(56) References Cited

U.S. PATENT DOCUMENTS

| | | | | | |
|---|---|---|---|---|---|
| 2,400,790 | A * | 5/1946 | Tolen | 5/284 |
| 2,401,605 | A * | 6/1946 | Boren | 5/97 |
| 3,292,611 | A * | 12/1966 | Belkin | 600/28 |
| 3,438,069 | A * | 4/1969 | Long | 5/422 |
| 4,066,072 | A * | 1/1978 | Cummins | 601/15 |
| 4,934,997 | A * | 6/1990 | Skakas | 600/26 |
| 4,947,832 | A | 8/1990 | Blitzer | |
| D317,994 | S | 7/1991 | Collins | |
| 5,697,113 | A * | 12/1997 | Shatz et al. | 5/655 |
| 6,004,259 | A | 12/1999 | Sedaros | |
| 6,175,981 | B1 * | 1/2001 | Lizama et al. | 5/655 |
| 6,912,743 | B1 * | 7/2005 | Weil | 5/93.1 |
| 7,587,772 | B2 * | 9/2009 | Ward | 5/655 |
| 7,771,375 | B2 * | 8/2010 | Nishibori et al. | 601/47 |
| 2002/0120176 | A1 | 8/2002 | Coviello | |
| 2002/0174488 | A1 * | 11/2002 | Appleton | 5/731 |
| 2007/0085695 | A1 | 4/2007 | Nerurkar | |
| 2009/0106894 | A1 * | 4/2009 | Yeo | 5/93.1 |

* cited by examiner

*Primary Examiner* — Michael Trettel

(57) ABSTRACT

An infant bed system having a base, a mattress with a top surface having a half-pipe indentation, the mattress is shaped and sized to be snugly placed atop the base, legs that extend downwardly from the base, and raised side walls that extend upwardly from the side wall of the base. A vibrating component in the base is adapted to provide vibrations to the mattress. A speaker produces womb sounds or heartbeat sounds. A control panel on the base allows for turning on and off of the system.

15 Claims, 4 Drawing Sheets

(Exploded View)

(Top View)

(ISO View)

(Exploded View)

(ISO View)

(Cross-sectional View)

(Top View)

(Block Diagram)

NEST-LIKE INFANT BED SYSTEM

BACKGROUND OF THE INVENTION

Many babies have difficulty sleeping at night or taking naps during the day. Some babies are irritable and require constant soothing. The present invention features a novel infant bed system. The system of the present invention features a foam mattress with a concave center resembling a nest. The mattress can be reversed (flipped over) and the opposite can be used as an alternative to the concave nest-like side. The system also features a vibrating component and ports that allow sounds (e.g. heartbeat sounds, womb sounds) to be played. The system of the present invention can help babies sleep and/or help keep babies happy (e.g., eliminate crying). The system of the present invention may be inserted into cribs.

SUMMARY

The present invention features a nest-like infant bed system. In some embodiments, the infant bed system comprises a base having a top surface, a side wall, and a bottom surface, wherein a lip extends upwardly from the side wall past the top surface; a mattress having a top surface and a bottom surface, the mattress is shaped and sized to be placed atop the top surface of the base snugly within the lip of the base, wherein a half-pipe indentation is disposed in the top surface of the mattress, wherein either the top surface or the bottom surface faces the top surface of the base; a vibrating component disposed in the base, the vibrating component is adapted to provide vibrations to the mattress; a speaker and an digital-to-analog converter each disposed in the base, the speaker is operatively connected to the digital-to-analog converter; a microprocessor operatively connected to at least the digital-to-analog converter and to a memory component, the memory component is adapted to hold at least one sound file; and a control panel disposed on the base, the control panel allows for turning on and off of the vibrating component and activation of the speaker whereby the microprocessor sends an output signal to the digital-to-analog converter to convert the sound file to an analog signal for the speaker.

In some embodiments, the base is rectangular in shape. In some embodiments, the system further comprises legs extending downwardly from the bottom surface of the base. In some embodiments, the system further comprises raised side walls extending upwardly from the side wall of the base a distance above the top surface of the base. In some embodiments, the raised side walls have top edges that are curved. In some embodiments, the distance is between about 6 to 18 inches. In some embodiments, the distance is between about 12 to 24 inches. In some embodiments, the distance is between about 12 to 36 inches. In some embodiments, the mattress is constructed from a material comprising foam. In some embodiments, the mattress is lined with a quilted material.

In some embodiments, the memory component is flash memory, electrically erasable programmable read-only memory (EEPROM), random access memory (RAM), read-only memory (ROM), or a combination thereof. In some embodiments, the sound file is a heartbeat sound, a womb sound, a lullaby, or a combination thereof.

In some embodiments, the system further comprises a fan disposed in the side walls, the fan is operatively connected to the microprocessor. In some embodiments, the system further comprises a monitor operatively connected to the microprocessor. In some embodiments, the system further comprises a heating element disposed in the base, the heating element is operatively connected to the microprocessor.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
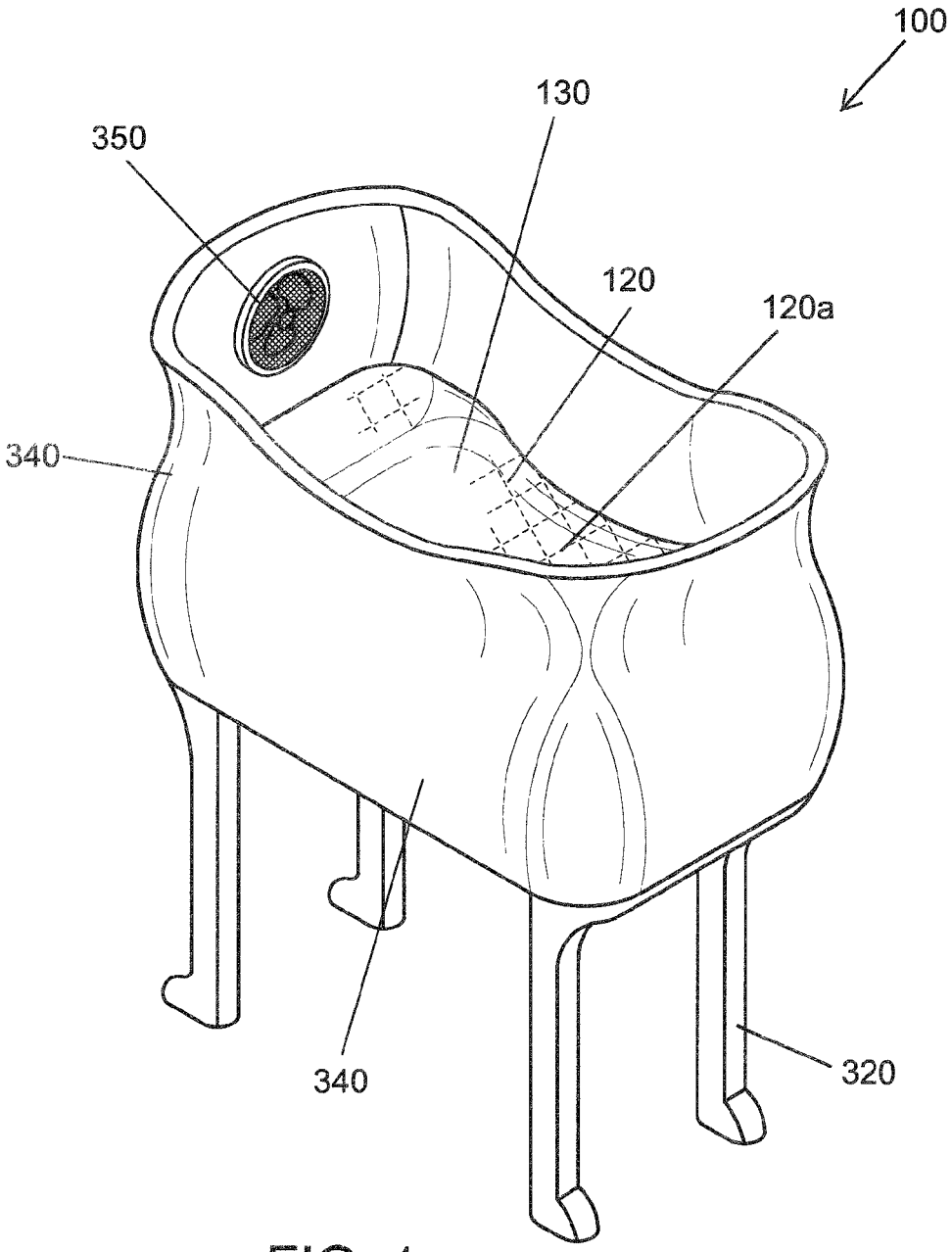
FIG. 1 is a perspective view of the system of the present invention.

Referring now to FIG. 1-6, the present invention features an infant bed system 100. The system 100 may be used in a crib (e.g., any sized crib), however the system 100 is not limited to use in a crib. The system 100 may be constructed in a variety of styles, designs, colors, and patterns.

The system 100 comprises a base 110 having a top surface 115, a bottom surface 116, and a side wall 111. A lip 117 extends upwardly from the side wall 111 past the top surface 115. The base 110 may be constructed in a variety of shapes. For example, in some embodiments, as viewed from above (e.g., the top surface 115), the base 110 has a rectangular shape (e.g., with rounded edges), an oval shape, etc. The base 110 is not limited to the shape shown in FIG. 1-6. In some embodiments, legs 320 (e.g., three legs, four legs, more than four legs, etc.) extend downwardly from the bottom surface 116 of the base 110. The legs 320 raise the base 110 a distance from the ground surface.

The system 100 further comprises a mattress 120. The mattress 120 is snugly inserted atop the top surface 115 of the base (sandwiched by the lip 117). The mattress 120 has a top surface 125 and a bottom surface 126. Either side of the mattress may be used (e.g., one side may be used for newborns, one side may be used for older infants and/or toddlers). For example, in some embodiments, the top surface 125 faces upwardly (e.g., see FIG. 1, FIG. 2). In some embodiments, the bottom surface 126 faces upwardly (e.g., see FIG. 3). Both sides of the mattress are designed to be comfortable for the infant or toddler. For example, in some embodiments, the mattress surfaces are lined with a quilted material 120*a*. The mattress 120 may be constructed from a variety of materials including but not limited to foam 120*b* (e.g., "memory" foam, which is well known to one of ordinary skill in the art). Any appropriate material or combinations of materials may be used.

Figure 2:
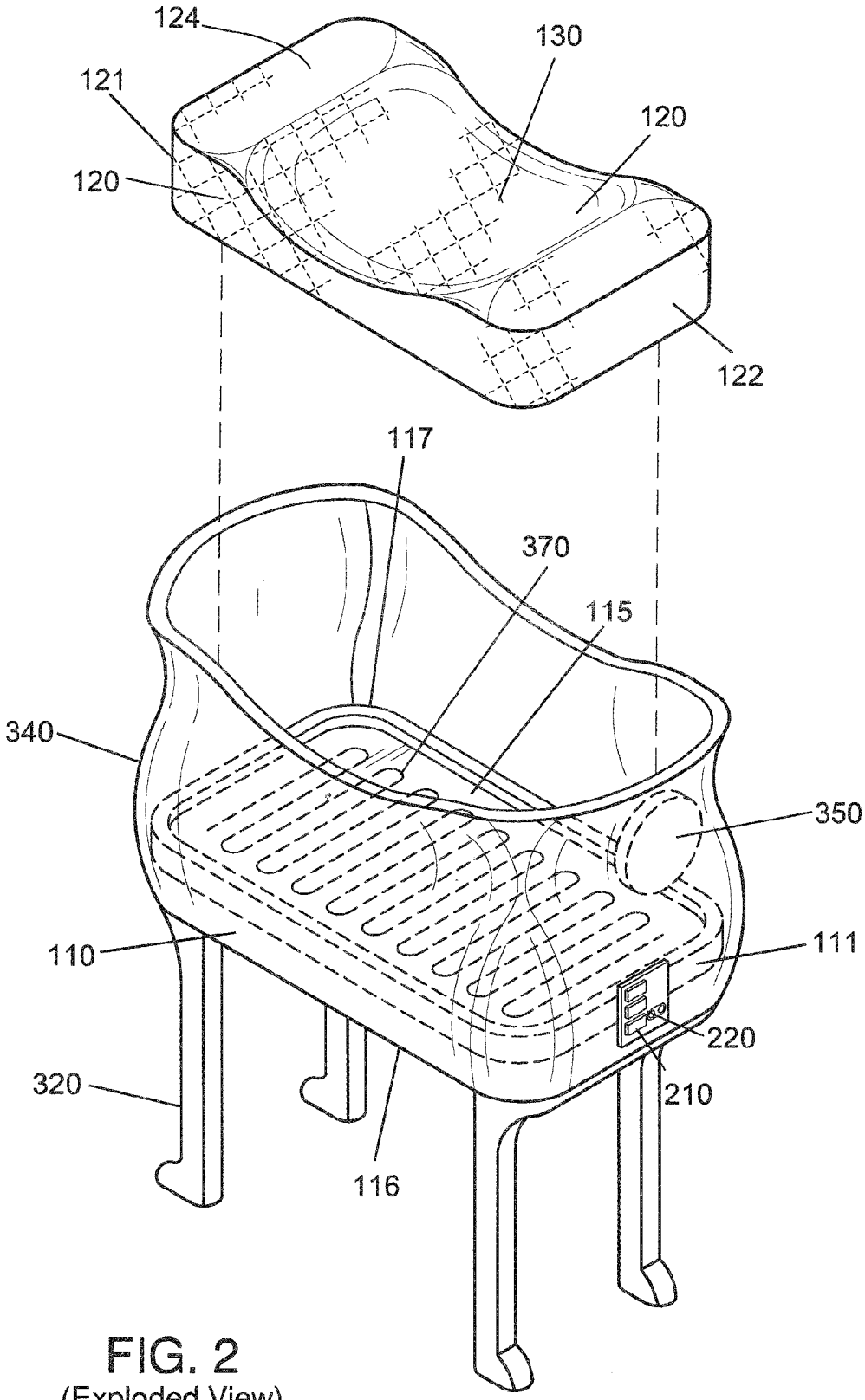
FIG. 2 is an exploded view of the system of the present invention.
Figure 3:
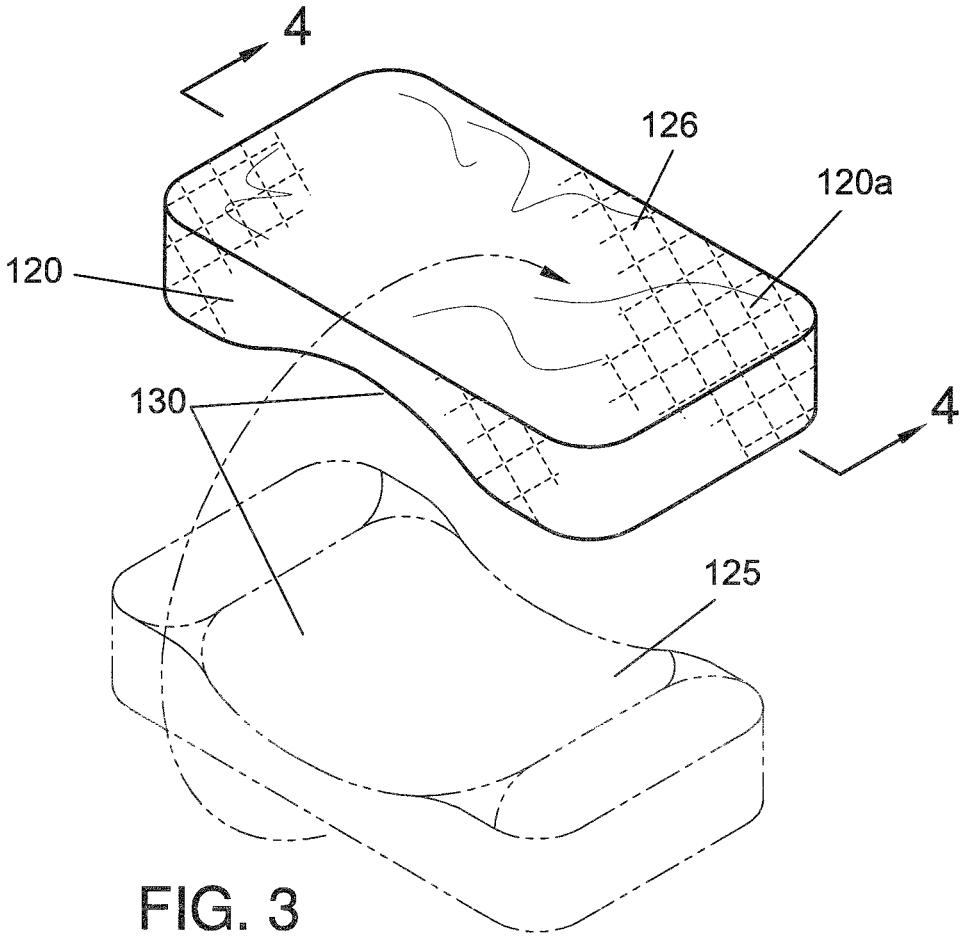
FIG. 3 is an exploded view of the system of the present invention (opposite side of the mattress is shown).
Figure 4:
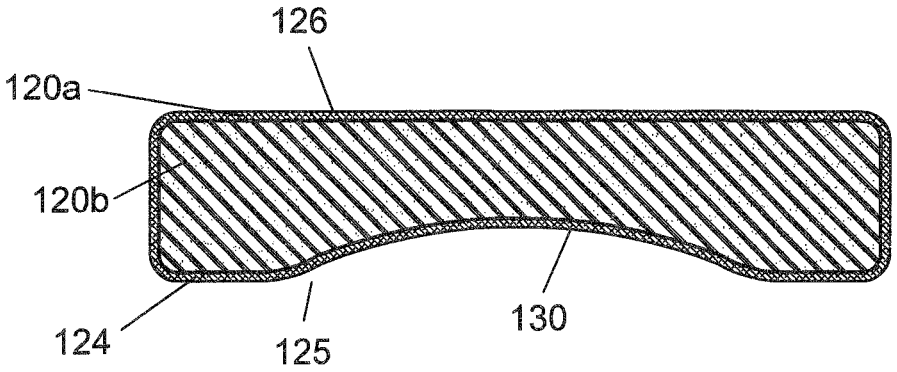
FIG. 4 is a cross sectional view of the system of the present invention.

As shown in FIG. 2, FIG. 3, and FIG. 4, a half-pipe indentation 130 (e.g., a "nest") is disposed in the top surface 125 of the mattress 120. The mattress 120 has a first end 121 and a second end 122. As shown in FIG. 2, the half-pipe indentation 130 is positioned perpendicularly to the length of the mattress 120 (the length being measured from the first end 121 to the second end 122). Raised ends 124 are disposed on the top surface 125 of the mattress at the first end 121 and on the top surface 125 of the mattress 120 at the second end 122 (the raised ends 124 are raised compared to the center of the mattress 120). In some embodiments, the bottom surface 126 of the mattress 120 may optionally be flat (e.g., see FIG. 4). Newborns can be placed in the indentation 130 for sleeping or comforting purposes; older infants and toddlers can be placed in the indentation 130 or on the flat side for sleeping or comforting purposes.

In some embodiments, the mattress 120 can be removed from the base 110 and placed in any crib.

The base 110 may be designed such that a baby cannot climb out. For example, in some embodiments, raised side walls 340 extend upwardly from the base 110 a certain distance above the base (see FIG. 1, FIG. 2). The raised side walls 340 may be have curved edges as shown in the figures.

Figure 5:
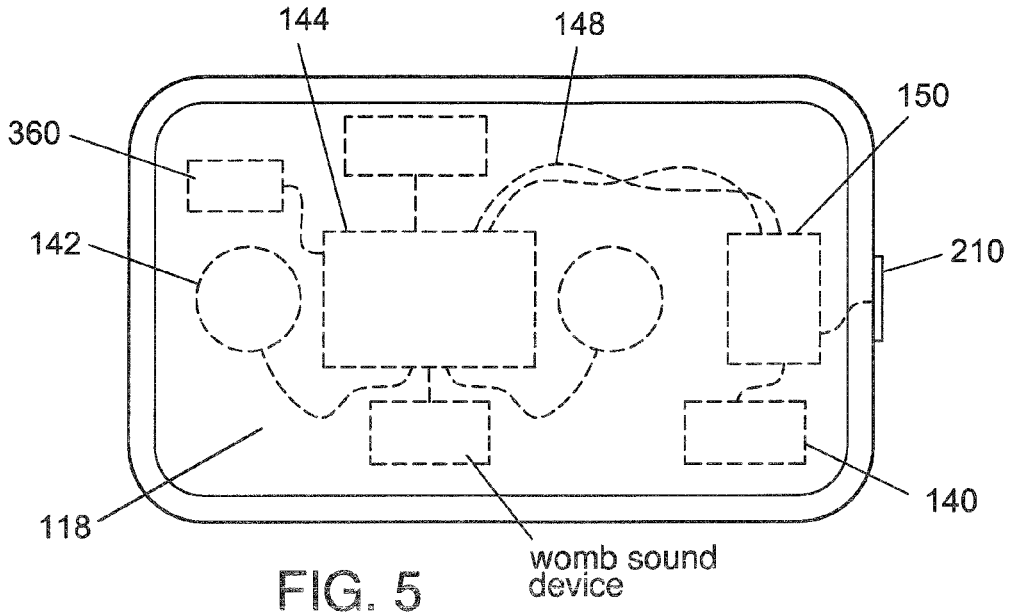
FIG. 5 is an internal view of the system of the present invention.
Figure 6:
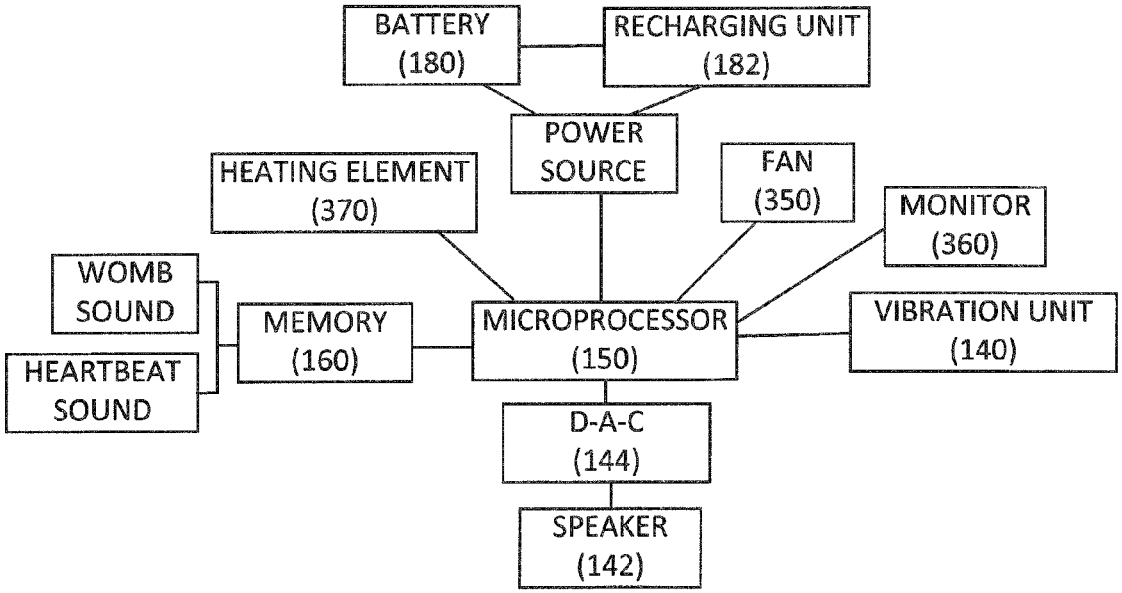
FIG. 6 is a schematic representation of the electrical components of the present invention.

As shown in FIG. 5, a vibrating component 140 is disposed in the base 110 (e.g., in the inner cavity 118). The vibrating component 140 is adapted to provide vibrations throughout the mattress 120. Vibrating components, particularly those used in infant devices, are well known to one of ordinary skill in the art.

In some embodiments, a speaker 142 (or multiple speakers) is disposed in the base 110 (e.g., in the inner cavity 118). The speaker 142 is operatively connected to a digital-to-analog converter 144 (sound unit). Digital to analog converters are well known to one of ordinary skill in the art. A microprocessor 150 is disposed in the base 110 (e.g., in the inner cavity 118). The speaker 142 and the vibrating component 140 are operatively connected to the microprocessor 150 (the speaker 142 is operatively connected to the digital-to-analog converter 144, which is operatively connected to the microprocessor 150 (e.g., via wiring 148).

In some embodiments, a fan 350 is disposed (e.g., removably disposed) in the side walls 340 (e.g., see FIG. 1). Fans are well known to one of ordinary skill in the art. The fan 350 may be operatively connected to the microprocessor 150 and/or a power source (e.g., battery, recharging unit). The fan 350 is designed to be safe for infants and toddlers.

In some embodiments, the system 100 comprises a monitor 360. Baby monitors are well known to one ordinary skill in the art. The monitor may be operatively connected to the microprocessor 150.

In some embodiments, a heating element 370 (e.g., a "warmer") is disposed in the base 110. Heating elements are well known to one of ordinary skill in the art. The heating element 370 may be operatively connected to the microprocessor 150.

The system 100 further comprises a memory component 160 (e.g., flash memory, electrically erasable programmable read-only memory (EEPROM), random access memory (RAM), read-only memory (ROM), etc.) operatively connected to the microprocessor 150. The memory component 160 comprises one or more sound files, for example sound files of heartbeats, womb sounds, lullabies, etc.

Disposed on the base 110 (e.g. on the side wall 111) is a control panel 210. The control panel 210 may feature buttons for turning on and off the vibrating component 140, turning on and off the fan, and/or turning on and off the heating element, etc. The control panel 210 may feature a port 220 for connecting an auxiliary device for adding or changing the sound files stored on the memory component 160 (e.g., a universal serial bus (USB) port). The control panel 210 (e.g., the buttons, port 220 is operatively connected to the microprocessor 150.

The system 100 further comprises a power source (e.g., rechargeable batteries 180, a recharging unit 182, an electrical cord/outlet, etc.). The power source may be operatively connected to the microprocessor 150.

As used herein, the term "about" refers to plus or minus 10% of the referenced number.

The disclosures of the following U.S. patents are incorporated in their entirety by reference herein: U.S. Pat. No. 4,066,072; U.S. Pat. No. 4,934,997; U.S. Pat. No. 4,947,832; U.S. Design Pat. No. D317994; U.S. Pat. No. 6,004,259: U.S. Patent Application No. 2010/0120176; and U.S. Patent Application No. 2007/0085695.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An infant bed system (100) for providing comfort to an infant, said system (100) comprising:

(a) a base (110) having a top surface (115), a side wall (111), and a bottom surface (116), wherein a lip (117) extends upwardly from the side wall (111) past the top surface (115);

(b) a mattress (120) having a top surface (125) and a bottom surface (126), the mattress (120) is shaped and sized to be placed atop the top surface (115) of the base (110) snugly within the lip (117) of the base (110), wherein a half-pipe indentation (130) is disposed in the top surface (125) of the mattress (120), wherein either the top surface (125) or the bottom surface (126) faces the top surface (115) of the base (110);

(c) a vibrating component (140) disposed in the base (110), the vibrating component (140) is adapted to provide vibrations to the mattress (120);

(d) a speaker (142) and an digital-to-analog converter (144) each disposed in the base (110), the speaker (142) is operatively connected to the digital-to-analog converter (144);

(e) a microprocessor (150) operatively connected to at least the digital-to-analog converter (144) and to a memory component (160), the memory component (160) is adapted to hold at least one sound file; and (f) a control panel (210) disposed on the base (110), the control panel (210) allows for turning on and off of the vibrating component (140) and activation of the speaker (142) whereby the microprocessor (150) sends an output signal to the digital-to-analog converter (144) to convert the sound file to an analog signal for the speaker (142).

2. The system (100) of claim 1, wherein the base (110) is rectangular in shape.

3. The system (100) of claim 1 further comprising legs (320) extending downwardly from the bottom surface (116) of the base (110).

4. The system (100) of claim 1 further comprising raised side walls (340) extending upwardly from the side wall (111) of the base (110) a distance above the top surface (115) of the base (110).

5. The system (100) of claim 4, wherein the raised side walls (340) have top edges that are curved.

6. The system (100) of claim 4, wherein the distance is between about 6 to 18 inches.

7. The system (100) of claim 4, wherein the distance is between about 12 to 24 inches.

8. The system (100) of claim 4, wherein the distance is between about 12 to 36 inches.

9. The system (100) of claim 1, wherein the mattress (120) is constructed from a material comprising foam.

10. The system (100) of claim 1, wherein the mattress (120) is lined with a quilted material (120*a*).

11. The system (100) of claim 1, wherein the memory component (160) is flash memory, electrically erasable programmable read-only memory (EEPROM), random access memory (RAM), read-only memory (ROM), or a combination thereof.

12. The system (100) of claim 1, wherein the sound file is a heartbeat sound, a womb sound, a lullaby, or a combination thereof.

13. The system (100) of claim 4, further comprising a fan (350) disposed in the side walls (340), the fan (350) is operatively connected to the microprocessor (150).

14. The system (100) of claim 1, further comprising a monitor (360) operatively connected to the microprocessor (150).

15. The system (100) of claim 1, further comprising a heating element (370) disposed in the base (110), the heating element (370) is operatively connected to the microprocessor (150).

* * * * *